US005362054A

United States Patent [19]

Ashemimry

[11] Patent Number: 5,362,054

[45] Date of Patent: Nov. 8, 1994

[54] MULTI-LAYERED EDUCATIONAL AND ENTERTAINING DEVICE INCLUDING A PLURALITY OF INDEPENDENT LAYERS

[75] Inventor: Nasir M. Ashemimry, Miami, Fla.

[73] Assignee: Businesship International, Inc., Coral Gables, Fla.

[21] Appl. No.: 119,452

[22] Filed: Sep. 10, 1993

Related U.S. Application Data

[63] Continuation-in-part of Ser. No. 938,792, Sep. 1, 1992, abandoned.

[51] Int. Cl.[5] ..... A63F 9/10

[52] U.S. Cl. ..... 273/157 R; 434/72; 434/368

[58] Field of Search ..... 273/157 R; 434/72, 79, 434/368, 369, 406

[56] References Cited

U.S. PATENT DOCUMENTS

| | | | |
|---|---|---|---|
| 609,347 | 8/1898 | Von Holzausen | 273/157 R |
| 1,709,660 | 4/1929 | De Bracht . | |
| 1,714,127 | 5/1929 | Graham | 273/157 R |
| 1,964,007 | 6/1934 | Parks | 273/157 R |
| 3,647,218 | 3/1972 | Foley et al. | 273/157 R |
| 3,682,479 | 8/1972 | Miller | 273/157 R |
| 3,879,861 | 4/1975 | Grantham | 273/157 R X |
| 4,142,726 | 3/1979 | Anderson | 273/157 R |
| 4,385,467 | 5/1983 | Samuels | 273/157 R |
| 4,469,331 | 9/1984 | Rinker . | |
| 4,815,742 | 3/1989 | Augustine . | |

FOREIGN PATENT DOCUMENTS

| | | | |
|---|---|---|---|
| 419311 | 11/1934 | United Kingdom | 434/72 |
| 434491 | 8/1935 | United Kingdom | 273/157 R |
| 1210452 | 10/1970 | United Kingdom | 273/157 R |

*Primary Examiner*—Paul E. Shapiro
*Attorney, Agent, or Firm*—Lott & Friedland

[57] ABSTRACT

A multi-layered educational and entertaining device including a plurality of independent layers, comprising a top planar layer comprising a plurality of irregularly-shaped pieces assembled together to form a top educational and entertaining picture, at least one intermediate planar layer comprising a plurality of irregularly-shaped pieces assembled together to form at least one intermediate educational and entertaining picture, and a bottom planar layer including a bottom puzzle portion and a raised decorative border extending inward from the bottom layer's outer edges and abutting the bottom puzzle portion, the bottom puzzle portion comprising at least one piece which forms a bottom educational and entertaining picture. The overall dimensions of the top layer and the intermediate layers are substantially the same as the overall dimensions of the bottom puzzle portion of the bottom layer, such that the layers, when positioned such that the intermediate layers are on top of the bottom puzzle portion and the top layer is on top of the intermediate layers, cover one another and abut the raised decorative border of the bottom layer. Each of the educational and entertaining pictures on each of the layers shares a common theme.

6 Claims, 3 Drawing Sheets

MULTI-LAYERED EDUCATIONAL AND ENTERTAINING DEVICE INCLUDING A PLURALITY OF INDEPENDENT LAYERS

This is a continuation-in-part of application Ser. No. 07/938,792, filed Sep. 1, 1992, now abandoned.

TECHNICAL FIELD

This invention relates generally to entertaining educational devices, and this invention specifically relates to a multi-layered jigsaw puzzle which appears as a two-dimensional puzzle board when assembled, but includes a number of independent internal layers sharing a common illustrative theme.

BACKGROUND OF THE INVENTION

In the amusement devices industry, puzzles are often utilized to perform the dual functions of providing entertainment to their users while simultaneously educating their users. By incorporating an educational theme into a puzzle, the puzzle may serve as an educational device. The education and entertainment functions may be enhanced by providing a puzzle with multiple layers.

Previous attempts to provide multi-layered educational and entertaining puzzles are generally described in U.S. Pat. No. 1,709,660, to DeBracht;, U.S. Pat. No. 1,964,007, to Parks; U.S. Pat. No. 3,682,479, to Miller et al.; U.S. Pat. No. 4,469,331, to Rinken and U.S. Pat. No. 4,815,742, to Augustine, all of which are incorporated herein by reference. The devices described in each of these references generally function to both entertain and educate their users.

However, each of the devices described in these references includes a plurality of layers which depend upon each other in order to perform the educational and entertainment functions associated therewith. For example, the device described in U.S. Pat. No. 1,709,660, to DeBracht, describes an amusement device embodying a number of elements or members which are assembled together into various combinations, each producing the completed picture or representation of an object, building, place, or scene. However, the individual elements or members described in DeBracht do not, independent of the remaining elements or members, produce a completed picture or representation of an object, building, place, or scene. All of the various elements or members of the device described in DeBracht must be assembled together in order to produce a completed picture. The same limitation holds true for the various layers of the devices described in the remaining patents which have been incorporated herein by reference.

The puzzles described in Great Britain Patent No. 1,210,452 to Whitehead, and Great Britain Patent No. 419,311 to Kinnard, incorporated herein by reference, when assembled, form three-dimensional objects either simulating the three dimensions of the object portrayed by the puzzle or simulating a geometrical solid structure such as a cube or pyramid. This geometrical solid structure also results when the puzzles in the patents to Parks and Miller are assembled. The disadvantage of these puzzles is that the user, knowing the geometrical solid structure portrayed, anticipates the order of assembly, making assembly easier. Storage of these type of puzzles is awkward, since the puzzles are large and variously shaped, unlike standard jigsaw puzzles and these geometrically solid puzzles cannot be displayed on the wall as a decorative work.

Thus, there is a need in the art for a multi-layered device which both educates and entertains its users.

There is an additional need in the art for such a device to perform its functions with layers capable of independently educating and entertaining the device's users.

There is an additional need in the art for such a device to include a plurality of layers which share a common educational theme.

There is an additional need in the art for a multi-layered device which resembles a standard one-layer jigsaw puzzle to provide for more convenient storage and allow for display as a decorative work.

SUMMARY OF THE INVENTION

The present invention fulfills the need in the art. Broadly described, the present invention provides a multi-layer educational and entertaining puzzle wherein each layer independently educates and entertains.

In a preferred embodiment of the present invention, the multi-layered puzzle comprises a top planar layer comprising a plurality of irregularly-shaped pieces assembled together to form a top educational and entertaining picture; at least one intermediate planar layer comprising a plurality of irregularly-shaped pieces assembled together to form at least one intermediate educational and entertaining picture; and a bottom planar layer including a bottom puzzle portion and a raised decorative border extending inward from the bottom layer's outer edges and abutting the bottom puzzle portion, the bottom puzzle portion comprising at least one piece which forms a bottom educational and entertaining picture.

In the preferred embodiment of the present invention, the overall dimensions of the top layer and the intermediate layers are substantially the same as the overall dimensions of the bottom puzzle portion of the bottom layer, such that the layers, when positioned such that the intermediate layers are on top of the bottom puzzle portion and the top layer is on top of the intermediate layers, cover one another and abut the raised decorative border of the bottom layer.

In the preferred embodiment of the present invention, each of the educational and entertaining pictures on each of the layers shares a common educational theme.

In a preferred embodiment of the present invention, the multi-layered puzzle further comprises a lever means attached to the bottom puzzle portion for disassembling the layers when the layers are positioned such that the intermediate layers are on top of the bottom puzzle portion and the top layer is on top of the intermediate layers.

In a preferred embodiment of the present invention, the layers are substantially narrow such that the top layer is flush with the raised decorative border of the bottom layer and the top layer and the decorative border are visible with the intermediate layers and the bottom puzzle portion completely concealed when the layers are assembled with the intermediate layers on top of the bottom puzzle portion and the top layer on top of the intermediate layers, whereby the puzzle, when assembled, is designed to resemble a completed one-layer puzzle board.

In a preferred embodiment of the present invention, the top layer resembles an image and the border resembles a frame, when completed, such that the puzzle can be displayed on a wall as a decorative work.

Accordingly, it is an object of the present invention to provide a multi-layered device which both educates and entertains its users.

It is another object of the present invention for such a device to perform its functions with layers capable of independently educating and entertaining the device's users.

It is another object of the present invention for such a device to include a plurality of layers which share a common educational theme.

These and other objects, features, and advantages of the present invention may be more clearly understood and appreciated from a review of the following detailed description of the disclosed embodiment and by reference to the appended drawings and claims.

BRIEF DESCRIPTION OF THE DRAWING FIGURES

DETAILED DESCRIPTION OF THE PREFERRED EMBODIMENT

Figure 1:
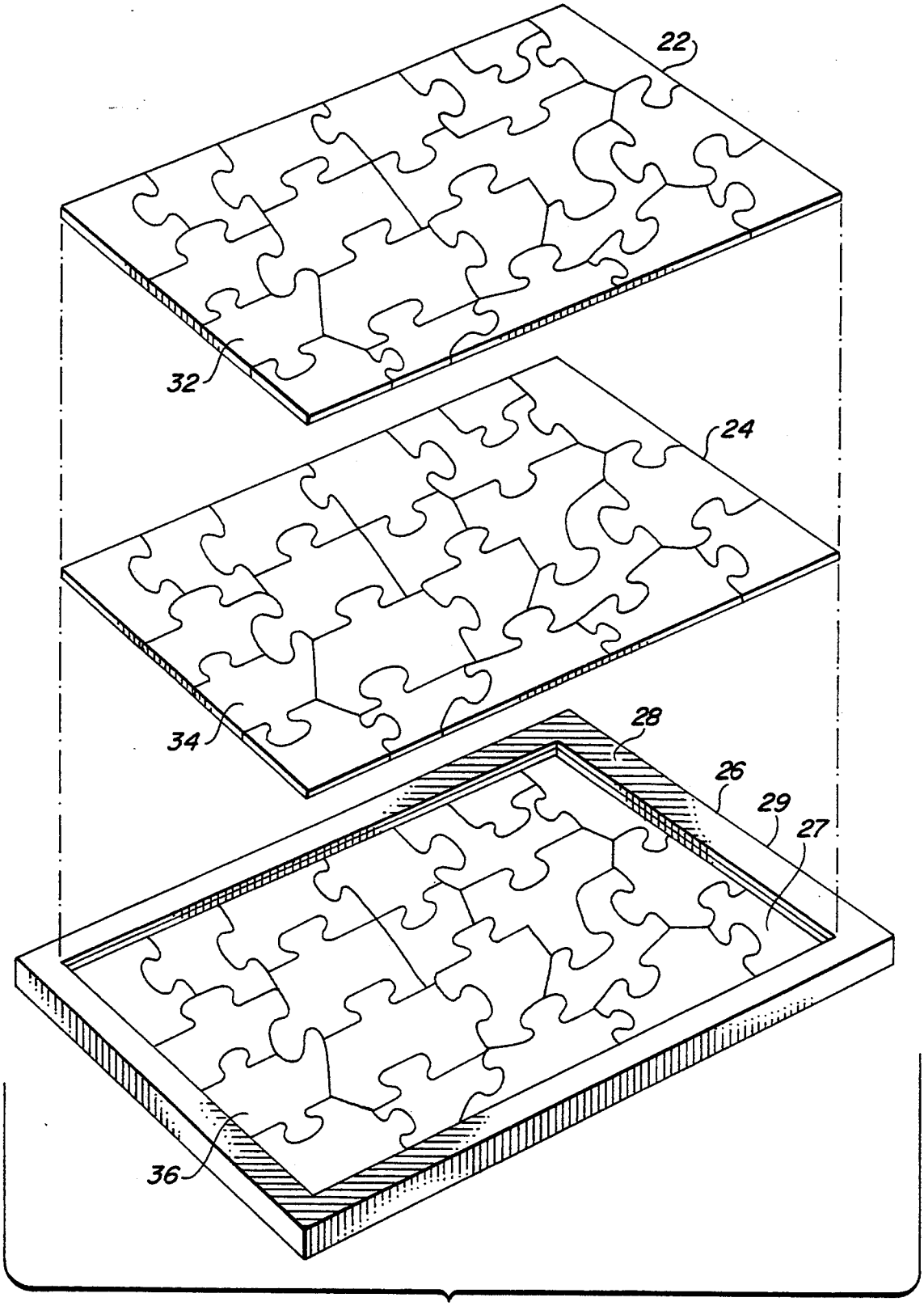
FIG. 1 is a perspective view of the preferred embodiment of the present invention which illustrates the various layers of the present invention, prior to the positioning of the layers upon one another.

Referring now to the drawings, in which like numerals indicate like elements throughout the several views, FIG. 1 is a perspective view of the numerous layers of the preferred embodiment of the multi-layer device 10 of the present invention. The layers include a top planar layer 22, at least one intermediate layer 24, and a bottom layer 26. The bottom layer 26 includes a bottom puzzle portion 27 and a raised decorative border 28 extending inward from the outer edges 29 of the bottom layer and abutting the bottom puzzle portion 27.

Each of the three layers 22, 24, 26 includes a plurality of irregularly-shaped pieces 32, 34, 36 which, when assembled together, respectively create a top educational and entertaining picture, an intermediate educational and entertaining picture, and a bottom educational and entertaining picture. In the preferred embodiment of the present invention, the three pictures share a common educational theme. For instance, the pieces 32 of the top layer 22, when assembled, preferably represent the exterior of a building, such as the historical mosques at Mecca or Medina, in Saudi Arabia; the pieces 34 of the intermediate layer 24, when assembled, preferably represent the interior of the same building, as though the roof of the building shown in the top layer 22 is removed; and the pieces 36 of the bottom layer 26, when assembled, preferably represent the land on which the building shown in the top and intermediate layers 22, 24 sits, including historical description of both the land and the building.

It should be noted that in the preferred embodiment of the present invention, the puzzle portion 27 of the bottom layer 26 may be a single-pieced unit rather than a plurality of pieces 36.

Figure 2:
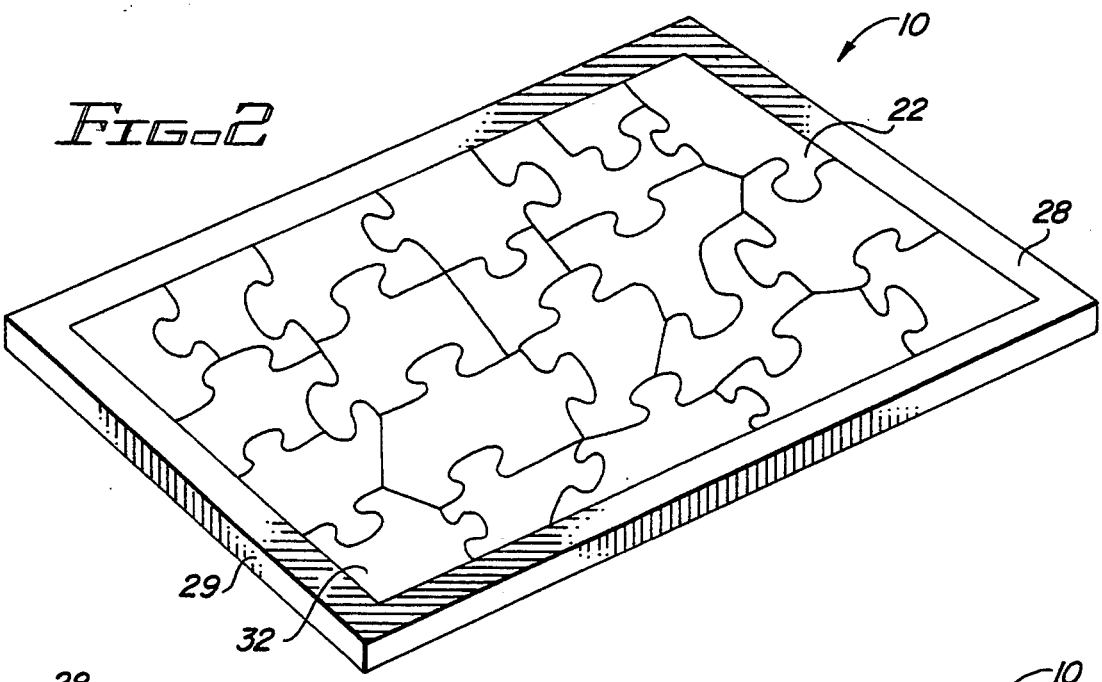
FIG. 2 is a perspective view of the preferred embodiment of the present invention which illustrates the various layers of the present invention, subsequent to the positioning of the layers upon one another.
Figure 3:
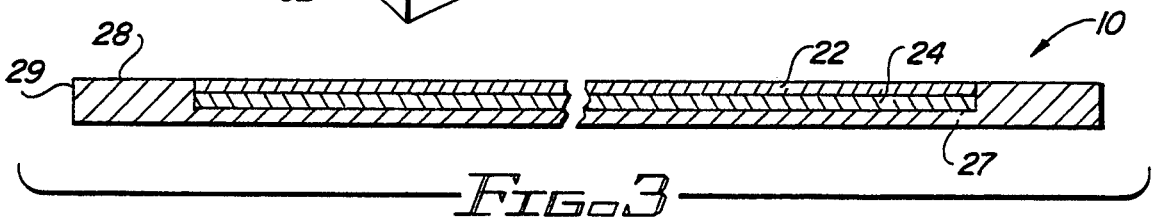
FIG. 3 is a cross-section view of the preferred embodiment of the present invention which illustrates the relationship between the decorative border and the layers.

FIGS. 2 and 3 depict the preferred embodiment of the present invention when the multiple layers 22, 24, 26 are placed on top of one another. The overall dimensions of the top layer 22, the intermediate layer 24, and the puzzle portion 27 of the bottom layer 26 are substantially the same. When the pieces 34 of the intermediate lawyer 24 are assembled on top of the puzzle portion 27 of the bottom layer 26 and the pieces 32 of the top layer 22 are in turn assembled on top of the intermediate layer 24, the top layer 22 is the only layer exposed to the user (not shown) of the device 10. The top layer 22 and intermediate layer 24, when assembled, abut the decorative border 28 of the bottom layer 26.

Figure 4:
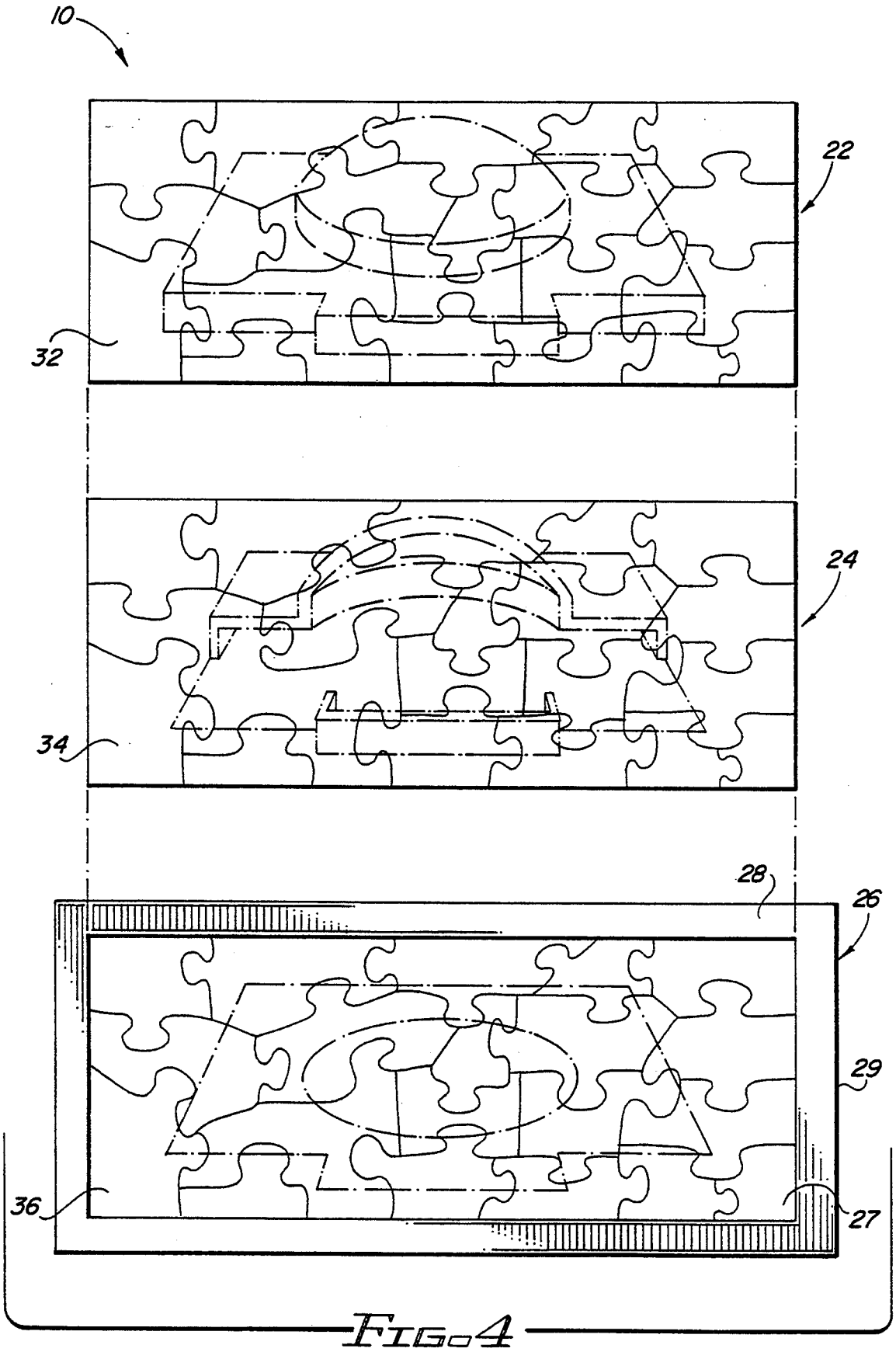
FIG. 4 is a perspective view of the preferred embodiment of the present invention which illustrates the various layers of the present invention, prior to the positioning of the layers upon one another, showing each layer forming an educational and entertaining picture, and sharing a common theme and dissectional relationship.

Referring now to FIG. 4, the preferred embodiment of the present invention is shown illustrating the dissectional relationship between the various layers of the multi-layer device 10 of the present invention. The layers, when disassembled, illustrate various cut-away sections of the complete building pictured on the top layer when assembled. These layers include a top planar layer 22, which forms a first cut-away section depicting the exterior of a building or structure when the irregularly-shaped pieces 32 are assembled together. At least one intermediate layer 24, forms an intermediate cut-away section depicting the interior of a building or structure when the irregularly-shaped pieces 34 are assembled together, as if the exterior roof shown in the top planar layer 22 had been removed, exposing the interior of the building or structure. The bottom layer 26 includes a bottom puzzle portion 27 formed from the irregularly shaped pieces 36 which, when assembled, form a final cut-away section. The bottom puzzle portion 27 illustrates the historical development of the land culminating in the construction of the building or structure depicted in the top and intermediate layers 22, 24. When assembled on top of one another, the layers 22, 24, 26 form a complete building or structure. A raised decorative border 28 extends inward from the outer edges 29 of the bottom layer 26. The assembled layers 22, 24, 26 appear as a two-dimensional object, with the intermediate layers 24 and bottom layer 26 hidden by the top layer 22 and the raised border 28.

In the preferred embodiment of the present invention, the device 10 may include a plurality of intermediate layers 24. For example, if a building to be depicted on the device includes a plurality of levels, an individual intermediate layer 24 may be devoted to each level.

Figure 5:
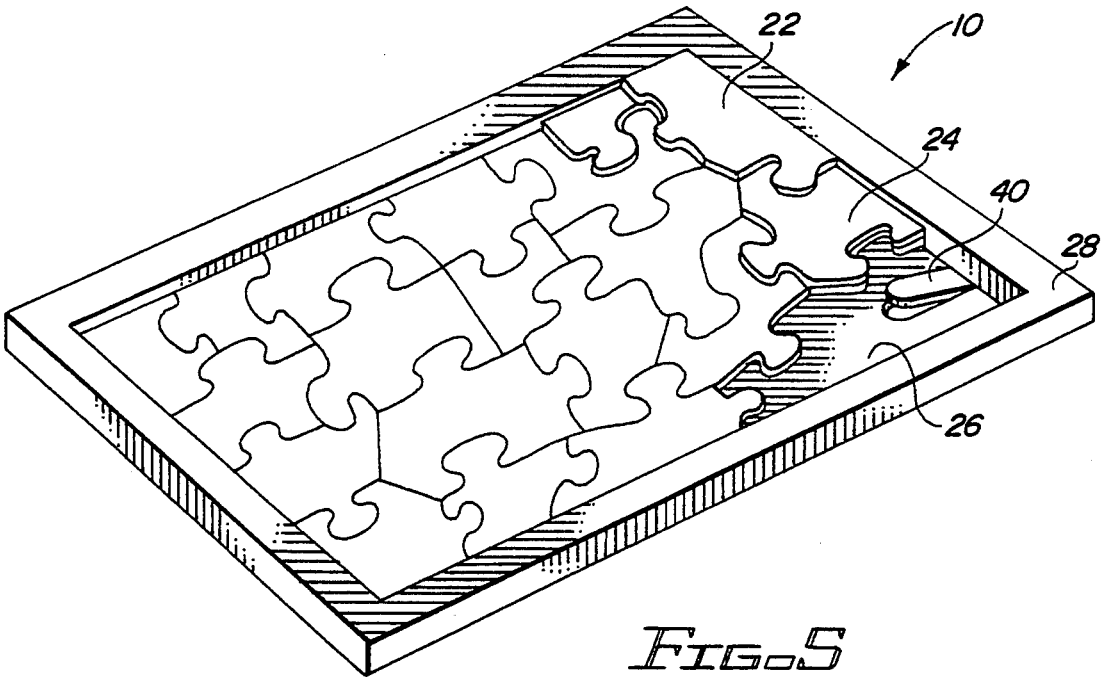
FIG. 5 is a perspective view of the preferred embodiment of the bottom puzzle portion of the present invention, showing the lever which aids in disassembling the invention.

Referring now to FIG. 5, a lever 40 attached to the bottom layer 26 is pushed upward toward the puzzle layers 22, 24, 26 to dislodge the multiple individual layers 22, 24, 26 and puzzle pieces 32, 34. The lever 40 aids in disassembly since the puzzle layers 22, 24, 26 are tightly fitted atop one another and within the raised decorative border 28.

Accordingly, it will be understood that both the preferred and alternative embodiments of the present invention have been disclosed by way of example and that other modifications and alterations may occur to those skilled in the art without departing from the scope and spirit of the appended claims.

What is claimed is:

1. A multi-layer educational and entertaining puzzle, comprising:

a top planar comprising a plurality of irregularly-shaped pieces assembled together to form a top educational and entertaining picture, forming a first cut-away section representing an exterior of a building or structure;

at least one intermediate planar layer comprising a plurality of irregularly-shaped pieces assembled together to form at least one intermediate educational and entertaining picture, each of said intermediate layers forming an intermediate cut-away section representing an interior portion of said building or structure; and a bottom planar layer including a bottom puzzle portion and a raised decorative border extending inward from said bottom layer's outer edges and abutting said bottom puzzle portion, said bottom puzzle portion comprising at least one piece which forms a bottom educational and entertaining picture, forming a final cut-away section representing a ground or surface upon which said building or structure is located and illustrating the historical development of said ground or surface culminating in the construction of said building or structure;

said layers appearing as a two-dimensional object when assembled; and said layers further having a dissectional relationship wherein each layer represents a cut-away section to be assembled to form a complete building or structure thereby educating and entertaining a user with the said building's structure and history; and a lever means attached to said bottom puzzle portion for disassembling said layers when said layers are positioned such that the intermediate layers are on top of said bottom puzzle portion and said top layer is on top of said intermediate layers.

2. The puzzle of claim 1, wherein the overall dimensions of said top layer and said intermediate layers are substantially the same as the overall dimensions of said bottom puzzle portion of said bottom layer, such that said layers, when positioned such that the intermediate layers are on top of said bottom puzzle portion and said top layer is on top of said intermediate layers, cover one another and abut said raised decorative border of said bottom layer.

3. The puzzle of claim 1, wherein said layers are substantially narrow such that said layer is flush with said raised decorative border of said bottom layer when said layers are assembled with said intermediate layers on top of said bottom puzzle portion and said top layer on top of said intermediate layers, whereby said puzzle, when assembled, is designed to resemble a completed one-layer puzzle board.

4. The puzzle of claim 3, wherein said top layer and said decorative border are visible with said intermediate layers and said bottom puzzle portion completely concealed when said layers are assembled with said intermediate layers on top of said bottom puzzle portion and said top layer on top of said intermediate layers.

5. The puzzle of claim 4, wherein when assembled said top layer resembles an image and said border resembles a frame, whereby said puzzle can be displayed as a decorative work.

6. A multi-layer educational and entertaining puzzle, comprising:

a top planar layer comprising a plurality of irregularly-shaped pieces assembled together to form a top educational and entertaining picture, forming a first cut-away section representing an exterior of a building or structure;

at least one intermediate planar layer comprising a plurality of irregularly-shaped pieces assembled together to form at least one intermediate educational and entertaining picture, each of said intermediate layers forming an intermediate cut-away section representing an interior of said building or structure;

a bottom planar layer including a bottom puzzle portion and a raised decorative border extending inward from said bottom layer's outer edges and abutting said bottom puzzle portion, said bottom puzzle portion comprising at least one piece which forms a bottom educational and entertaining picture, forming a final cut-away section representing a ground or surface upon which said building or structure is located and illustrating the historical development of said ground or surface culminating in the construction of said building or structure, wherein the overall dimensions of said top layer and said intermediate layers are substantially the same as the overall dimensions of said bottom puzzle portion of said bottom layer, such that said layers, when positioned such that the intermediate layers are on top of said bottom puzzle portion and said top layer is on top of said intermediate layers, cover one another and abut said raised decorative border of said bottom layer, and further wherein each of said educational and entertaining pictures on each of said layers has a dissectional relationship as cut-away sections of said building or structure wherein said user is educated as to said building's structure and history, and said layers appearing as a two-dimensional object when assembled; and a lever means attached to said bottom puzzle portion for disassembling said layers when said layers are positioned such that the intermediate layers are on top of said bottom puzzle portion and said top layer is on top of said intermediate layers.

* * * * *